US006027318A

United States Patent [19]

Shimanuki et al.

[11] Patent Number: 6,027,318

[45] Date of Patent: Feb. 22, 2000

[54] MAGNETICALLY DRIVEN PUMP

[75] Inventors: Shizuo Shimanuki, Anjyo; Norio Sasaki, Aichi-ken, both of Japan

[73] Assignees: Aisin Seiki Kabushiki Kaisha; Toyota Jidosha Kabushiki Kaisha, both of Aichi-ken, Japan

[21] Appl. No.: 08/722,915

[22] Filed: Sep. 23, 1996

[30] Foreign Application Priority Data

Sep. 26, 1995 [JP] Japan ..... 7-247401

[51] Int. Cl.[7] ..... F04B 17/00

[52] U.S. Cl. ..... 417/420; 417/423.7

[58] Field of Search ..... 415/203; 417/420, 417/423.1, 423.7

[56] References Cited

U.S. PATENT DOCUMENTS

| | | | |
|---|---|---|---|
| 2,399,856 | 5/1946 | Coger | 417/420 |
| 2,796,028 | 6/1957 | Beagle | 415/203 |
| 3,609,068 | 9/1971 | Fays | 417/420 |
| 4,574,644 | 3/1986 | Lew et al. | 417/420 |
| 5,248,246 | 9/1993 | Lew et al. | 417/420 |

FOREIGN PATENT DOCUMENTS

| | | | |
|---|---|---|---|
| 60-159899 | 10/1985 | Japan . | |
| 63-189690 | 8/1988 | Japan . | |
| 2-153281 | 6/1990 | Japan | 417/420 |
| 6-185483 | 7/1994 | Japan | 417/420 |
| 1379498 A1 | 3/1988 | U.S.S.R. | 417/420 |

*Primary Examiner*—Timothy Thorpe
*Assistant Examiner*—Peter G. Korytnyk
*Attorney, Agent, or Firm*—Hazel & Thomas, P.C.

[57] ABSTRACT

A magnetically driven pump includes a pump chamber, an impeller held in the pump chamber so as to be rotatable about a central axis, a drive unit for rotatively driving the impeller, and a magnetic attraction system provided on the drive unit and impeller for rotating the impeller by mutual magnetic force. At least one of the first and second magnetic attraction devices is provided in parallel with the central axis and being provided also in front of and in back of the pump in the axial direction.

7 Claims, 3 Drawing Sheets

MAGNETICALLY DRIVEN PUMP

BACKGROUND OF THE INVENTION

This invention relates to a magnetically driven pump of the type in which an impeller is rotatively driven by magnetic force. The pump is capable of being used in a water pump or the like in a water cooling system of an internal combustion engine for an automotive vehicle.

A water jacket is formed in a vehicle engine in order to cool the engine, and a water pump is connected to the water jacket. The water pump has a pump chamber that communicates with the water jacket, and an impeller is supported within the pump chamber so as to be capable of rotating about its axis.

A water pump disclosed in Japanese Utility Model Laid-Open Publication No. Sho 60-159899(1985) includes a driven permanent magnet secured to an impeller at the position of its central axis. A drive shaft having a driving permanent magnet in parallel with its central axis is employed as a drive unit in a crank chamber, which is partitioned from the pump chamber by a partitioning plate. The driven permanent magnet of the impeller and the driving permanent magnet of the drive shaft constitute magnetic attraction means for rotatively driving the impeller by their magnetic forces.

Further, Japanese Patent Laid-Open Publication No. Sho 63-189690(1988) discloses a pump having a permanent-magnet rotor formed as an integral part of an impeller in a pump chamber, and a solenoid-type stator serving as a drive unit secured in a stator chamber partitioned from the pump chamber. The permanent-magnet rotor forming part of the impeller and the solenoid-type stator serve as magnetic attraction means and construct a motor.

In these conventional magnetically driven pumps, the magnetic force of the magnetic attraction means formed by the driving permanent magnet of the drive shaft provided in parallel with the central axis or by the solenoid-type stator influences, from one direction, the magnetic attraction means formed by the driven permanent magnet of the impeller or by the permanent-magnet rotor of the impeller, wherein these magnetic attraction means are provided in parallel with the central axis. As a result, the impeller is driven into rotation and produces a circulatory flow inside the pump chamber. By partitioning the pump chamber retaining the impeller from the crank chamber or stator chamber holding the drive shaft or solenoid-type stator, the drive unit is provided outside the pump chamber. Consequently, in comparison with an ordinary pump in which the pump chamber and crank chamber are sealed by mechanical seals, it is possible to prevent noise and leakage of fluid from the mechanical seals. Another advantage is their simpler structure.

However, a shortcoming of these conventional magnetically driven pumps is that since the magnetic attraction means are provided in parallel with the central axis, the mutual magnetic force is inadequate. As a consequence, the impeller cannot follow up sudden fluctuations in rotational speed and it is difficult to rotate the impeller at high speed. If such a pump is used to cool an engine, the result is a loss in the circulation of fluid and a decrease in circulatory flow rate. The end result is unsatisfactory cooling of the engine.

If both magnetic attraction means are elongated along the central axis with a view to rotating the impeller reliably at high speed, the result is a longer pump in the axial direction. This makes it more difficult to install the pump in a vehicle.

SUMMARY OF THE INVENTION

Accordingly, an object of the present invention is to provide a magnetically driven pump in which the impeller is capable of following up sudden fluctuations in rotational speed and can be rotated at high speed in reliable fashion.

According to the present invention, the foregoing object is attained by providing a magnetically driven pump comprising a pump chamber, an impeller held in the pump chamber so as to be rotatable about a central axis to produce flow in a fluid inside the pump chamber by this rotation, a drive unit, which is provided exterior to the pump chamber by a partitioning wall, for rotatively driving the impeller, and first and second magnetic attraction means provided on the drive unit and impeller, respectively, for rotatively driving the impeller by mutual magnetic force, at least one of the first and second magnetic attraction means being provided in parallel with the central axis and being provided also in at least one of in front of and in back of the pump in the axial direction.

In the pump according to the invention, at least one of the magnetic attraction means of the drive unit and the magnetic attraction means of the impeller is provided in parallel with the central axis and is provided also in at least one of in front of and in back of the pump in the axial direction. As a result, magnetic forces act in two or three direction between the two magnetic attraction means, and a satisfactory mutual magnetic force is obtained without elongating both magnetic attraction means in the axial direction. Accordingly, if there is a sudden change in rotational speed or if it is desired to rotate the impeller at high speed, the impeller will be able to follow up the drive unit. The impeller is thus rotated to reliably produce a flow in the fluid within the pump chamber.

Further, the drive unit is provided externally of the pump chamber by virtue of the partitioning wall. consequently, in comparison with an ordinary pump in which the pump chamber and crank chamber are sealed by mechanical seals, it is possible to prevent noise and leakage of fluid from the mechanical seals. In addition, the overall structure is simplified.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

First and second embodiments of the present invention will now be described in detail with reference to the drawings.

(First Embodiment)

Figure 1:
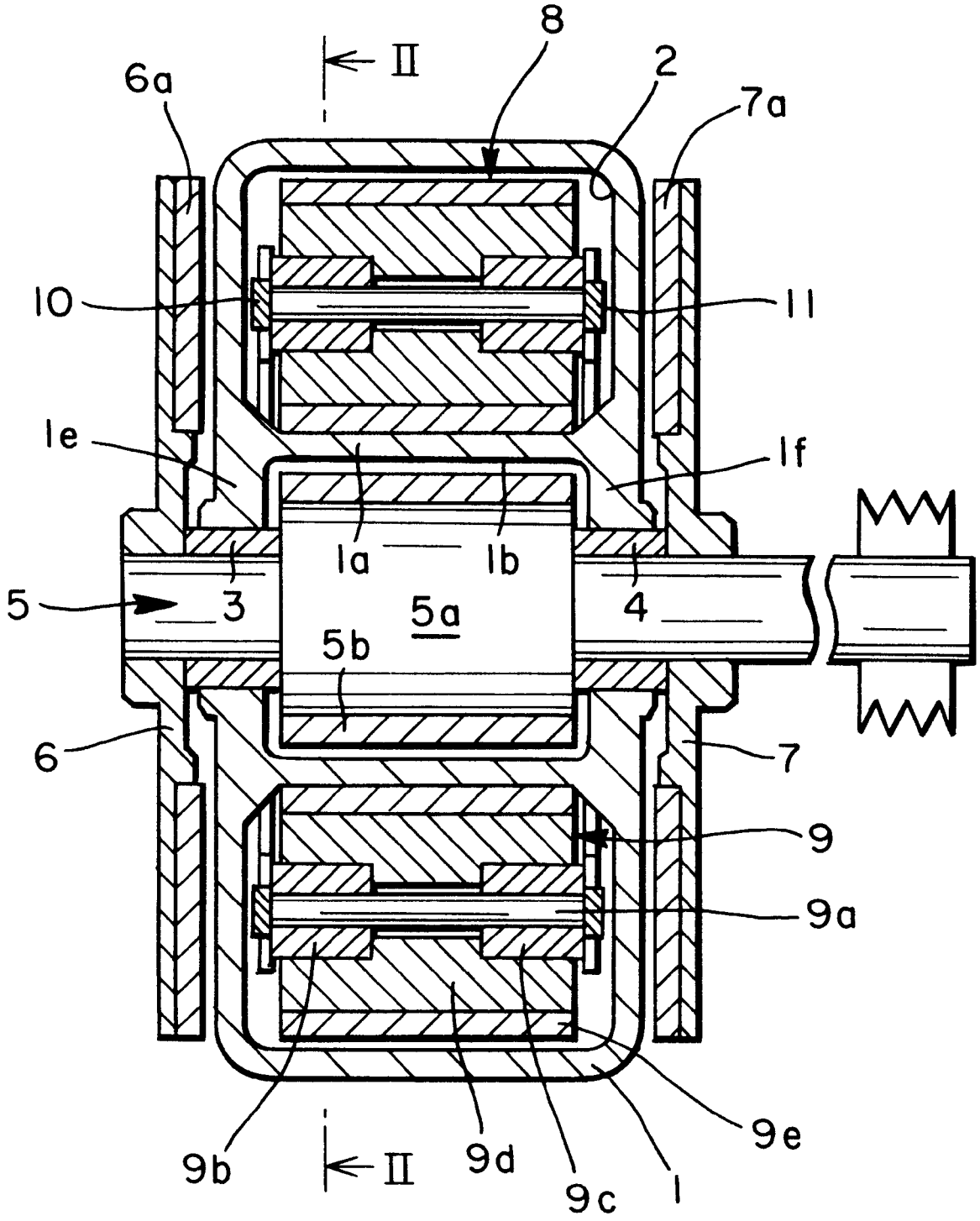
FIG. 1 is a longitudinal sectional view illustrating a positive-displacement magnetically driven water pump according to a first embodiment of the present invention.
Figure 2:
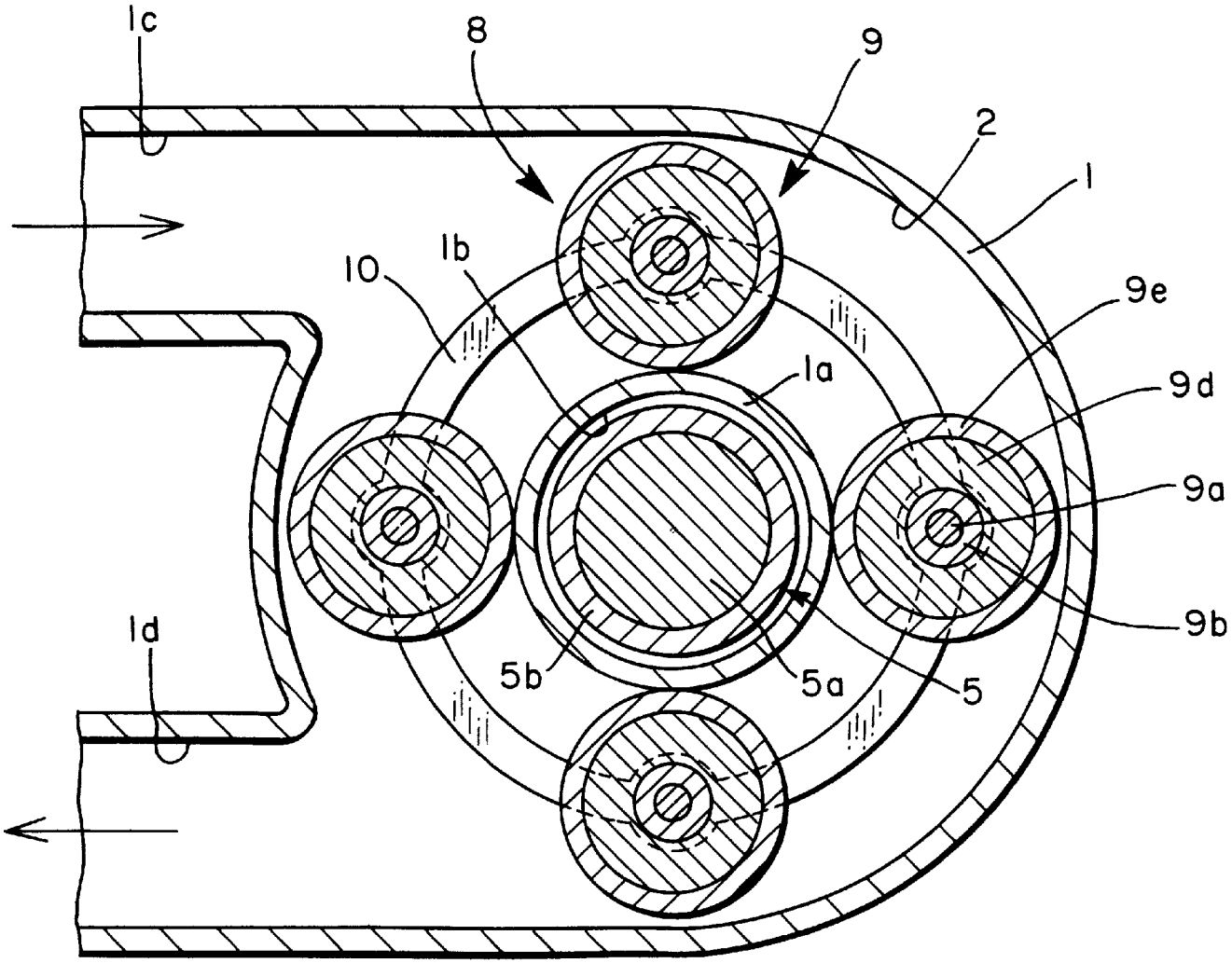
FIG. 2 is a sectional view, taken along line II—II of FIG. 1, illustrating the positive-displacement magnetically driven water pump according to the first embodiment of the present invention.

In the first embodiment, as illustrated in FIGS. 1 and 2, the invention is applied to a magnetically driven water pump.

The water pump includes a case 1 in which a central hole 1*b* is formed by a partitioning wall 1*a*. A ring-shaped pump chamber 2 is formed inside the case 1 and communicates with a water jacket, which is formed in an engine (not shown), by an inlet 1*c* and an outlet 1*d* opened in the radial direction. A drive shaft 5 is rotatably supported in the central hole 1*b* between inner flanges 1*e*, 1*f* via plain bearings 3, 4. The central portion of the drive shaft 5 is enlarged to form a large-diameter portion 5*a* that is rotatable between inner flanges 1*e*, 1*f*.

A driving permanent magnet 5*b* serving as one magnetic attraction means is secured to the outer periphery of the large-diameter portion of drive shaft 5. A front plate 6 opposing the front face of the case 1 is press-fitted on the front end of the drive shaft 5, a rear plate 7 facing the rear face of the case 1 is press-fitted on the rear of the drive shaft 5, and a pulley (not shown) is secured to the rear end of the drive shaft 5. Driving permanent magnets 6*a*, 7*a* serving as one other magnetic attraction means are secured to the front plate 6 and rear plate 7, respectively, on the sides thereof facing the case 1. The large-diameter portion 5*a* of the drive shaft 5, the front plate 6 and the rear plate 7 thus construct a drive unit. Further, the driving permanent magnet 5*b* is secured to the large-diameter portion 5*a* so as to lie parallel to the central axis, and the driving permanent magnets 6*a*, 7*a* are secured to the front plate 6 and rear plate 7, respectively, so as to be provided in front and back of the driving permanent magnet 5*b* in the axial direction.

A rotor means 8 serving as an impeller is accommodated within the pump chamber 2. The rotor means 8 comprises four rollers 9, and ring-shaped connecting members 10, 11 for holding the rollers 9 in such a manner that the rollers are spaced away from one another equidistantly. Each roller 9 comprises a rod 9*a* secured to the connecting members 10, 11, a roller body 9*d* rotatably held on the rod 9*a* by plain bearings 9*b*, 9*c*, and a driven permanent magnet 9*e*, serving as other magnetic attraction means, secured to the outer periphery of the roller body 9*d*.

If the drive shaft 5 in this water pump is rotated via the pulley, the driving permanent magnet 5*b* of the large-diameter portion 5*a* and the driving permanent magnets 6*a*, 7*a* of the front and rear plates 6, 7, respectively, exert magnetic forces, from three directions, upon the driven permanent magnet 9*e* of each roller 9 in the rotor means 8. As a result, the rotor means 8 revolves about the central axis and each roller 9 of the rotor means 8 rotates about its own rod 9*a*. At this time a satisfactory mutual magnetic force is obtained without elongating the driving permanent magnet 5*b* and the driven permanent magnet 9*e* along the axial direction. The rotor means 8 and rollers 9 will follow up the large-diameter portion 5*a* of drive shaft 5 and the front and rear plates 6, 7 even if the rotational speed of the drive shaft 5 fluctuates or even when it is desired to rotate the rotor 8 and rollers 9 at high speed. By thus moving the rollers 9 inside the ring-shaped pump chamber 2, a circulating flow is reliably produced inside the pump chamber 2 owing to the volume between the rollers 9.

Accordingly, the water pump of this embodiment is easily installed, the rotor 8 and rollers 9 are capable of following up sudden fluctuations in rotational speed, and the rotor 8 and rollers 9 can be rotated at high speed. As a result, circulation can be produced reliably and the engine can be cooled in an optimum fashion.

Further, the large-diameter portion 5*a* of the drive shaft 5, the front plate 6 and the rear plate 7 are provided outside the pump chamber 2 in the water pump of this invention. Consequently, in comparison with an ordinary pump using mechanical seals, it is possible to prevent noise and leakage of fluid that would be produced by mechanical seals. In addition, the overall structure is simplified.

(Second Embodiment)

Figure 3:
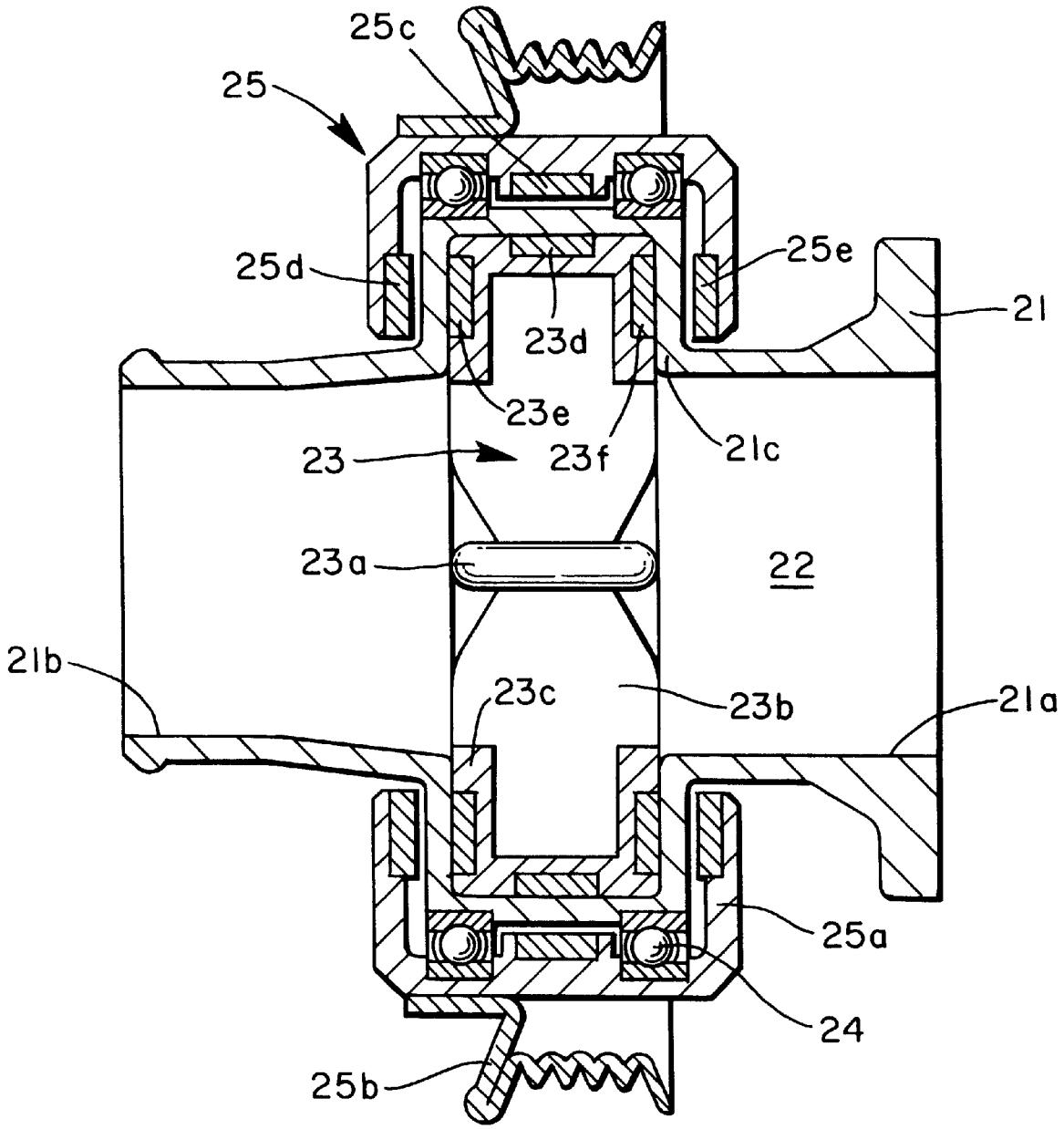
FIG. 3 is a longitudinal sectional view illustrating an axial-flow magnetically driven water pump according to a second embodiment the present invention.

In the second embodiment, as illustrated in FIG. 3, the invention is applied to an axial-flow magnetically driven water pump.

The water pump according to this embodiment includes a cylindrical case 21 in which an axial-like pump chamber 22 is formed. The pump chamber 22 communicates with a water jacket, which is formed in an engine (not shown), by an inlet 21*a* and an outlet 21*b* opened longitudinally. The central portion of the case 21 is formed to have an enlarged portion 21*c* whose inner and outer circumferences are of increased size. An impeller 23 is accommodated inside the enlarged portion 21*c*. The impeller 23 comprises a shaft portion 23*a* extending in the axial direction, a plurality of vanes 23*b* secured to the shaft portion 23*a* so as to extend diametrically, and driven permanent magnets 23*d*, 23*e*, 23*f* serving as one magnetic attraction means secured to the outer ends of the vanes 23*b* via fixing members 23*c*. In other words, the driven permanent magnets 23*d*, 23*e*, 23*f* are provided in the axial direction and on front and rear sides in the axial direction. Thus, the driven permanent magnet 23*d* is provided in parallel with the central axis and the driven permanent magnets 23*e*, 23*f* are provided in front and back of the driven permanent magnet 23*d* in the axial direction.

Further, a pulley 25 is rotatably held on the diametrically outer side of the enlarged portion 21*c* via a bearing 24, with the case 21 per se serving as the partitioning wall. The pulley 25 comprises a pulley body 25*a* covering the enlarged portion 21*c* along its axially extending side as well as its front and rear sides in the axial direction, and a belt body 25*b* secured to the outer peripheral surface of the pulley body 25*a*. Driving permanent magnets 25*c*, 25*d*, 25*e* serving as other magnetic attraction means opposing the driven permanent magnets 23*d*, 23*e*, 23*f*, respectively, are secured to the enlarged portion 21*c* of the pulley body 25 on its axially extending side as well as its front and rear sides in the axial direction. Thus, the pulley 25 constructs a drive unit. The driving permanent magnet 25*c* is provided in parallel with the central axis and the driving permanent magnets 25*d*, 25*e* are provided in front and back of the driving permanent magnet 25*c* in the axial direction.

If the pulley 25 in this water pump is rotated, the driving permanent magnets 25*c*, 25*d*, 25*e* exert magnetic forces, from three directions, upon the driven permanent magnets 23*d*, 23*e*, 23*f* of the impeller 23. As a result, the impeller 23 rotates about the central axis. At this time a satisfactory mutual magnetic force is obtained without elongating the driving permanent magnet 25*c* and the driven permanent magnet 23*d* along the axial direction. The impeller 23 will follow up the pulley 25 even if it is desired to rotate the impeller 23 at high speed. By thus causing the vanes 23*b* of the impeller 23 to agitate the interior of the pump chamber 22, the circulating fluid flows in the form of a spiral within the pump chamber 22.

Accordingly, the water pump of this embodiment can be easily installed, the impeller 23 is capable of following up sudden fluctuations in rotational speed and can be rotated reliably at high speed. As a result, the engine can be cooled in optimum fashion by this water pump.

Further, the pulley 25 in this water pump is provided externally of the pump chamber 22. Consequently, in comparison with an ordinary pump using mechanical seals, it is possible to prevent noise and leakage of fluid that would be produced by mechanical seals. In addition, the overall structure is simplified.

Thus, as described above, the magnetically driven pump according to the present invention is such that the impeller is capable of following up sudden fluctuations in rotational speed and of being rotated at high speed. This is made possible without sacrificing ease of installation.

As many apparently widely different embodiments of the present invention can be made without departing from the spirit and scope thereof, it is to be understood that the invention is not limited to the specific embodiments thereof except as defined in the appended claims.

What is claimed is:

1. A magnetically driven pump comprising:

a pump chamber;

an impeller held in said pump chamber so as to be rotatable about a central axis to produce flow of a fluid inside the pump chamber while the impeller is being rotated;

a drive unit, which is provided external to said pump chamber by a partitioning wall, for rotatively driving said impeller; and first and second magnetic attraction means provided on the drive unit and impeller, respectively, for rotatively driving said impeller by mutual magnetic force, at least one of said first and second magnetic attraction means being provided in parallel with the central axis and the other of said first and second magnetic attraction means being provided in front of and in back an the pump in the axial direction.

2. A magnetically driven pump according to claim 1, wherein a cylindrical case for defining the pump chamber therein has an inlet port and an outlet port which are opened longitudinally and the impeller is composed of plurality of vanes, the second magnetic attraction means being attached on outer ends of the vanes.

3. A magnetically driven pump according to claim 2, wherein a pulley is rotatably held on the cylindrical case and around the vanes and the first magnetic attraction means is attached on inner faces of the pulley which are opposed to a part of the cylindrical case.

4. A magnetically driven pump according to claim 3, wherein the cylindrical case has an enlarged portion in which the vanes are housed and around which the pulley is located.

5. A magnetically driven pump comprising:

a pump chamber:

an impeller held in said pump chamber so as to be rotatable about a central axis to produce flow is a fluid inside the pump chamber while the impeller is being rotated;

a drive unit, which is provided external to said pump chamber by a partitioning wall, for rotatively driving said impeller; and first and second magnetic attraction means provided on the drive unit and impeller, respectively, for rotatively driving said impeller by mutual magnetic force, at least one of said first and second magnetic attraction means being provided in parallel with the central axis and the other of the first and second magnetic attraction means being provided in front of and in back of the pump in an axial direction, wherein the impeller is composed of a plurality of rollers which are circumferentially spaced away from one another and connected by connecting members inside the pump chamber.

6. A magnetically driven pump according to claim 5, wherein the first magnetic attraction means is provided on an outer surface of an enlarged drive shaft of the drive unit which is coupled to a pulley and on plates facing to opposed side surfaces of a pump case for defining the pump chamber, and the second magnetic attraction means is provided on each of the rollers.

7. A magnetically driven pump according to claim 5, wherein the drive unit is a drive shaft which is coupled to a pulley and around which the rollers are arranged.

* * * * *